US009068484B2

(12) United States Patent
Bennett

(10) Patent No.: US 9,068,484 B2
(45) Date of Patent: Jun. 30, 2015

(54) DOUBLE-REED EXHAUST VALVE ENGINE

(71) Applicant: Charles L. Bennett, Livermore, CA (US)

(72) Inventor: Charles L. Bennett, Livermore, CA (US)

(73) Assignee: Lawrence Livermore National Security, LLC, Livermore, CA (US)

( * ) Notice: Subject to any disclaimer, the term of this patent is extended or adjusted under 35 U.S.C. 154(b) by 153 days.

(21) Appl. No.: 13/794,436

(22) Filed: Mar. 11, 2013

(65) Prior Publication Data

US 2014/0251256 A1 Sep. 11, 2014

(51) Int. Cl.

| | |
|---|---|
| ***F02B 41/04*** | (2006.01) |
| ***F02F 3/00*** | (2006.01) |
| ***F01L 11/02*** | (2006.01) |
| ***F01L 3/00*** | (2006.01) |
| ***F01L 21/02*** | (2006.01) |
| ***F01L 3/20*** | (2006.01) |
| *F02B 75/40* | (2006.01) |
| *F02B 1/04* | (2006.01) |
| *F02B 75/32* | (2006.01) |
| *F01L 7/02* | (2006.01) |

(52) U.S. Cl.

CPC ..... *F01L 21/02* (2013.01); *F02B 2275/36* (2013.01); *F02B 75/40* (2013.01); *F02B 1/04* (2013.01); *F02B 41/04* (2013.01); *F02B 75/32* (2013.01); *F01L 3/205* (2013.01); *F01L 7/02* (2013.01); *F01L 2101/00* (2013.01); *F01L 2820/01* (2013.01)

(58) Field of Classification Search

CPC ..... F02B 75/40; F02B 2275/36; F02B 41/04; F02B 75/32; F02B 1/04

USPC ..... 123/196.6, 188.1, 47 R, 47 A, 47 AA, 123/47 AB

See application file for complete search history.

(56) References Cited

U.S. PATENT DOCUMENTS

| | | | |
|---|---|---|---|
| 3,609,969 | A | 10/1971 | Gerber |
| 3,712,337 | A | 1/1973 | Kice et al. |
| 3,971,213 | A | 7/1976 | Kelley |
| 3,971,217 | A | 7/1976 | Firth et al. |
| 4,047,384 | A | 9/1977 | Saruwatari |
| 4,099,447 | A | 7/1978 | Ogles |

(Continued)

FOREIGN PATENT DOCUMENTS

| | | | |
|---|---|---|---|
| GB | 2089887 | A * | 6/1982 |
| JP | 58046276 | A | 9/1981 |
| WO | 2008156913 | A3 | 4/2008 |

OTHER PUBLICATIONS

Geva, et al., "On the classical limit of quantum thermodynamics in finite time", J. Chem. Phys., 97, (6), pp. 4398-4412 (Sep. 15, 1992).

(Continued)

*Primary Examiner* — Lindsay Low
*Assistant Examiner* — Charles Brauch
(74) *Attorney, Agent, or Firm* — James S. Tak

(57) ABSTRACT

An engine based on a reciprocating piston engine that extracts work from pressurized working fluid. The engine includes a double reed outlet valve for controlling the flow of low-pressure working fluid out of the engine. The double reed provides a stronger force resisting closure of the outlet valve than the force tending to open the outlet valve. The double reed valve enables engine operation at relatively higher torque and lower efficiency at low speed, with lower torque, but higher efficiency at high speed.

20 Claims, 16 Drawing Sheets

(56) References Cited

U.S. PATENT DOCUMENTS

| | | | | |
|---|---|---|---|---|
| 4,120,316 | A | 10/1978 | Robinson, Jr. | |
| 4,161,163 | A * | 7/1979 | Boyesen | 123/73 A |
| 4,184,409 | A | 1/1980 | Hinchman et al. | |
| 4,457,670 | A | 7/1984 | Tomson et al. | |
| 4,889,034 | A | 12/1989 | Husted | |
| 5,020,486 | A * | 6/1991 | Unger | 123/79 R |
| 5,095,809 | A | 3/1992 | Kroger | |
| 5,456,076 | A | 10/1995 | Zornes | |
| 5,493,944 | A | 2/1996 | Felkins et al. | |
| 6,279,520 | B1 | 8/2001 | Lowi, Jr. | |
| 7,174,824 | B2 | 2/2007 | Koskimaki et al. | |
| 7,603,858 | B2 | 10/2009 | Bennett | |
| 7,752,957 | B2 | 7/2010 | Chrupalla et al. | |
| 7,992,652 | B2 | 8/2011 | Plunkett | |
| 2001/0003257 | A1 | 6/2001 | Simonds | |
| 2004/0045429 | A1 | 3/2004 | Rosa | |
| 2004/0050242 | A1 | 3/2004 | Roberts et al. | |
| 2004/0060429 | A1 | 4/2004 | Rehkemper et al. | |
| 2004/0200216 | A1 * | 10/2004 | Klostermann | 60/512 |
| 2006/0230917 | A1 | 10/2006 | Britz | |
| 2007/0266846 | A1 | 11/2007 | Simmons et al. | |
| 2008/0148932 | A1 | 6/2008 | Chrupalla et al. | |
| 2008/0276615 | A1 | 11/2008 | Bennett | |
| 2012/0260795 | A1 | 10/2012 | Rampen et al. | |

OTHER PUBLICATIONS

King, et al., "The design and characteristics of piezomotors using flexure-hinged displacement amplifiers", Robotics and Autonomous Systems, 19, pp. 189-197 (1996).

Szwedowicz, et al., "Nonlinear Dynamic Analyses of a Gas Turbine Blade for Attainment of Reliable Shroud Coupling", Proceedings of GT2005, ASME, vol. 4, pp. 553-561 (Jun. 6-9, 2005).

Filiz, et al., "Analysis of a Flexible Cylindrical Structure for a Harmonic Motor Drive", IEEE, pp. 510-517 (2007).

Li, et al., Out-plane Dynamics Analysis for the Electromechanical Integrated Electrostatic Harmonic Motor, IEEE, pp. 4672-4676 (2009).

* cited by examiner

DOUBLE-REED EXHAUST VALVE ENGINE

FEDERALLY SPONSORED RESEARCH OR DEVELOPMENT

The United States Government has rights in this invention pursuant to Contract No. DE-AC52-07NA27344 between the United States Department of Energy and Lawrence Livermore National Security, LLC or the operation of Lawrence Livermore National Laboratory.

TECHNICAL FIELD

This invention occurred generally relates to pressure activated engines or motors. More particularly, this invention is a reciprocating-piston engine having reed valves controlling the flow of working fluid in the engine.

BACKGROUND

Engines that transform the internal energy within a pressurized expansible fluid into useful mechanical energy are well known. Perhaps the earliest and best known is the steam engine. Central to the operation of such an engine is the valve mechanism that controls the admission of high-pressure fluid into an expansible chamber and the release of low-pressure fluid from the expansible chamber. The power and efficiency of such an engine is strongly driven by the phasing of the opening and closing of the inlet and outlet valves. Maintaining high efficiency and high power under a variety of pressure conditions and operating speeds requires changing the phasing of the valves opening and closing, and a number of mechanisms are known to achieve such variable valve timing. However, known mechanisms tend to be complex and expensive to manufacture, and there is a need for a simple valve mechanism that is inexpensive to manufacture and that has high reliability and is capable of changing operation in response to engine speed and pressure.

SUMMARY

One aspect of the present invention includes an engine comprising: a cylinder having an inlet and an outlet positioned at a first end of the cylinder; a piston slidably arranged in the cylinder to together enclose an expansion chamber accessible by the inlet and the outlet, and to move away from the first end of the cylinder during a power stroke and toward the first end of the cylinder during an exhaust stroke; an inlet valve for controlling the flow of working fluid from a pressurized fluid source through the inlet into the expansion chamber to effect the power stroke; an exhaust valve for controlling the flow of working fluid exhausted out through the outlet from the expansion chamber during at least a portion of the exhaust stroke, the exhaust valve comprising first and second resiliently-biasing members positioned between the piston and the outlet and co-extending substantially adjacent each other, the first member positioned between the second member and the outlet to occlude the outlet when resiliently biased to a closed position, and the second member positioned between the piston and the first member to resiliently bias the first member to the closed position when the second member is itself resiliently biased by movement of the piston during at least a portion of the exhaust stroke; and periodic return means operably connected to the piston for effecting the exhaust stroke after each power stroke.

Another aspect of the present invention includes a harmonic engine comprising: a cylinder having an inlet and an outlet positioned at a first end of the cylinder; a piston slidably arranged in the cylinder to together enclose an expansion chamber accessible by the inlet and the outlet, and to move away from the first end of the cylinder during a power stroke and toward the first end of the cylinder during an exhaust stroke; an inlet valve for controlling the flow of working fluid from a pressurized fluid source through the inlet into the expansion chamber to effect the power stroke, the inlet valve comprising an inlet valve head and a resiliently biasing member arranged together as a harmonic oscillator so that the inlet valve head is moveable against an equilibrium restoring force of the resiliently biasing member from an unbiased equilibrium position located outside the expansion chamber to a biased closed position occluding the inlet, and so that upon releasing from the closed position the inlet valve head undergoes at least one oscillation past the equilibrium position to an oppositely biased maximum open position and returns to a biased return position between the closed and equilibrium positions to choke the flow of working fluid and produce a pressure drop across the inlet valve causing the inlet valve to close; an exhaust valve for controlling the flow of working fluid exhausted out through the outlet from the expansion chamber during at least a portion of the exhaust stroke, the exhaust valve comprising first and second resiliently-biasing members positioned between the piston and the outlet and co-extending substantially adjacent each other, the first member positioned between the second member and the outlet to occlude the outlet when resiliently biased to a closed position, and the second member positioned between the piston and the first member to resiliently bias the first member to the closed position when the second member is itself resiliently biased by movement of the piston during at least a portion of the exhaust stroke, wherein the second member is adapted to dampen harmonic oscillation of the first member when the first member is released from the closed position; and periodic return means operably connected to the piston for effecting the exhaust stroke after each the power stroke.

Another aspect of the present invention includes a harmonic engine comprising: a cylinder having an inlet and an outlet positioned at a first end of the cylinder; a piston slidably arranged in the cylinder to together enclose an expansion chamber accessible by the inlet and the outlet, and to move away from the first end of the cylinder during a power stroke and toward the first end of the cylinder during an exhaust stroke; an inlet valve for controlling the flow of working fluid from a pressurized fluid source through the inlet into the expansion chamber to effect the power stroke, wherein the inlet valve comprises an inlet valve head and a resiliently biasing member arranged together as a harmonic oscillator so that the inlet valve head is moveable against an equilibrium restoring force of the resiliently biasing member from an unbiased equilibrium position located outside the expansion chamber to a biased closed position occluding the inlet, and so that upon releasing from the closed position the inlet valve head undergoes at least one oscillation past the equilibrium position to an oppositely biased maximum open position and returns to a biased return position between the closed and equilibrium positions to choke the flow of working fluid and produce a pressure drop across the inlet valve causing the inlet valve to close; an exhaust valve for controlling the flow of working fluid exhausted out through the outlet from the expansion chamber during at least a portion of the exhaust stroke, the exhaust valve comprising first and second resiliently-biasing members positioned between the piston and the outlet and co-extending substantially adjacent each other, the first member positioned between the second member and the outlet to occlude the outlet when resiliently biased to a closed position, and the second member positioned between the piston and the first member to resiliently bias the first member to the closed position when the second member is itself resiliently biased by movement of the piston during at least a portion of the exhaust stroke; and a crank assembly for effecting the exhaust stroke of the engine after each power stroke, the crank assembly having a flywheel and a piston rod having one end rotatably connected to the flywheel and an opposite end fixedly connected to the piston to couple rotational motion of the flywheel to wobble motion of the piston as it reciprocates in the cylinder, wherein the piston has a flexible flange positioned between the piston and the walls of the cylinder so as to seal the expansion chamber as the piston undergoes the wobble motion, and the crank assembly is arranged to tilt the piston towards the outlet on the exhaust stroke and to tilt the piston towards the inlet on the power stroke, so that the second member is bumped by the piston during the exhaust stroke to further bump the first member towards the closed position, and wherein the cylinder has at least one vent port spaced from the first end of the cylinder to partially exhaust working fluid from the expansion chamber when the piston passes the vent port during the power stroke so as to sufficiently reduce a pressure differential across the first member in the closed position to release the first member from occluding the outlet in advance of the exhaust stroke.

BRIEF DESCRIPTION OF THE DRAWINGS

The accompanying drawings, which are incorporated into and form a part of the disclosure, are as follows.

DETAILED DESCRIPTION

Generally, the present invention is an engine that converts the energy contained within a pressurized supply of a working fluid, such as steam or compressed air, into mechanical power. The engine generally comprises a reciprocating-piston expander assembly and a crank assembly or other periodic return mechanism or method operably connected to the piston for effecting the return stroke of the expander after each power stroke. The expander generally includes the following components and sub-assemblies: an inlet valve for controlling flow of high pressure working fluid into expansion chamber from a supply of pressurized working fluid; and an exhaust valve for controlling the flow of working fluid out of the expansion chamber. In particular, the exhaust valve includes a first resiliently biasing (e.g. flexible) member positioned between the piston and the outlet, and further includes a second resiliently biasing (e.g. flexible) member positioned between the first flexible member and the piston. It is appreciated that a resiliently biasing member is a structure which is capable of being biased, flexed, or otherwise contorted from an unstressed position/configuration to a stressed position/configuration, but is resilient in that it has a tendency to return to the unstressed position/configuration when the force causing the stress is removed. It is appreciated that such a resiliently biasing member when used as a valve, is typically characterized as a "reed valve." As such, the exhaust valve of the present invention may be characterized as a double-reed exhaust valve, and the engine a double-reed exhaust valve engine. A crank assembly is operably connected to the piston for converting reciprocating motion into rotary power output.

As one example the crank assembly may include a flywheel having rotational inertia that is transferred to the piston via a connecting rod.

First Embodiment

Figure 1:
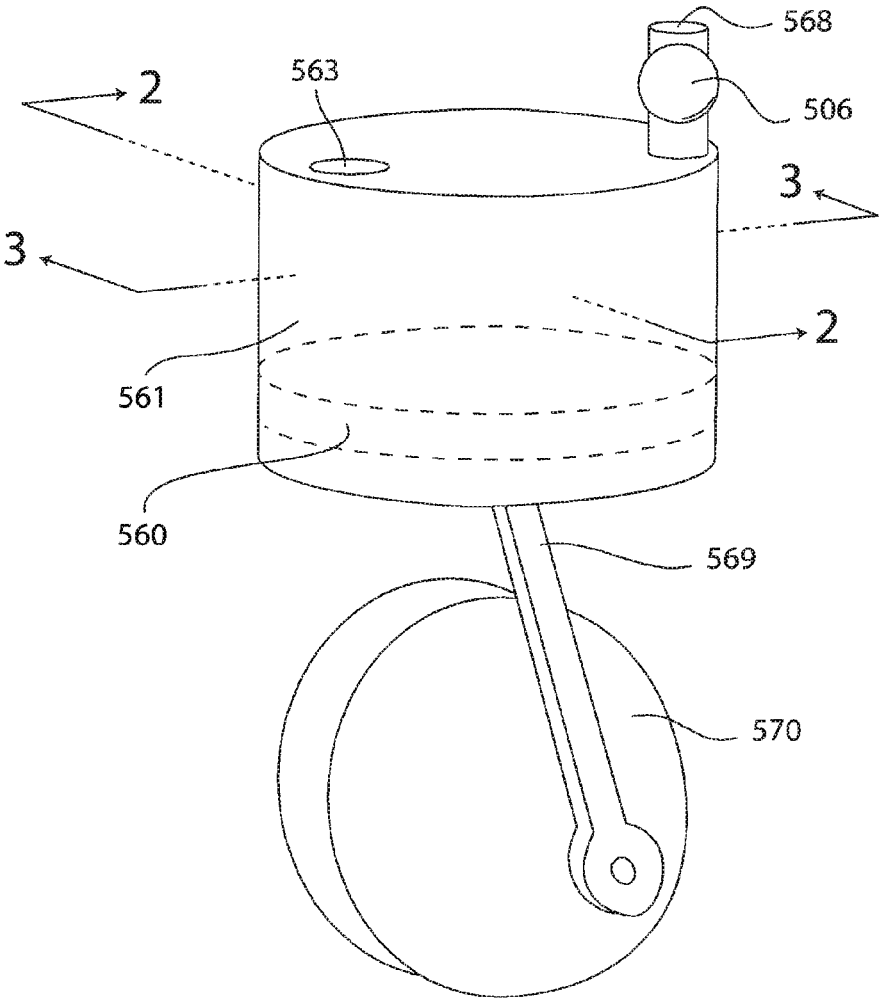
FIG. 1 is a perspective view of the first embodiment.
Figure 2:
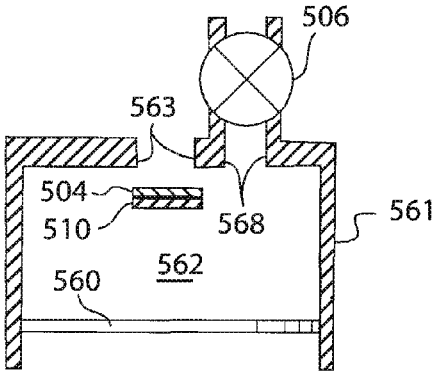
FIG. 2 is a cross-sectional view of the first embodiment taken along line 2-2 of FIG. 1, with the thickness of the reeds exaggerated for illustration purposes, and showing the reeds not occluding the outlet 563.
Figure 26:
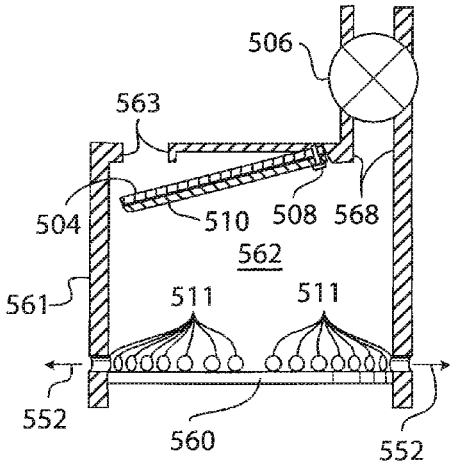
Figure 27:
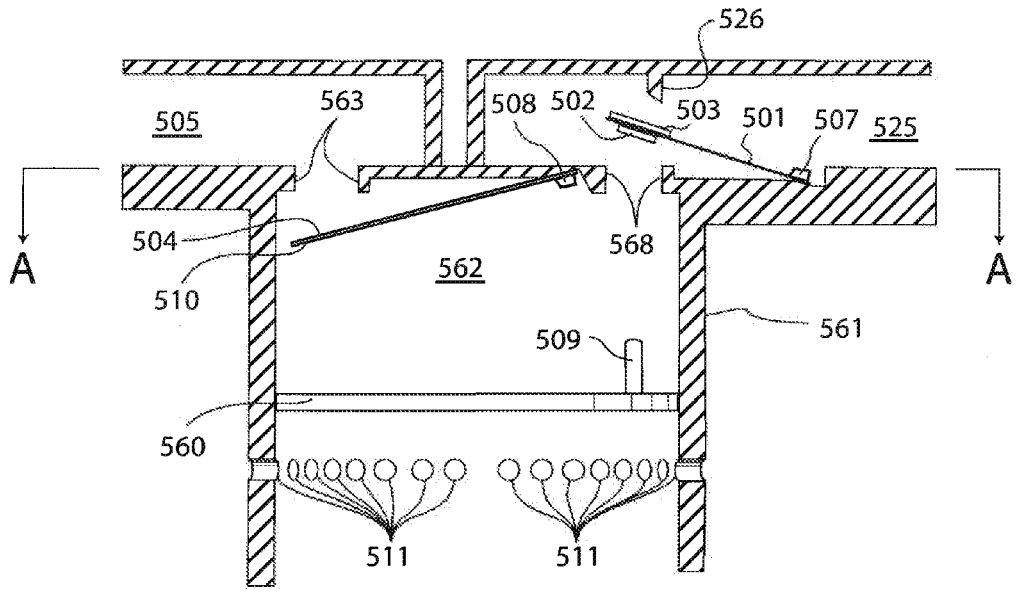
FIG. 27 is a cross-sectional view of a third embodiment that has vent ports near BDC and a harmonic inlet valve.

Turning now to the drawings, the first embodiment of the double reed engine is shown in FIG. 1 in perspective view, and along two partial sectional views in FIGS. 2-5. In the first embodiment, the outlet valve is comprised of a pair of flexible reeds, with upper reed 504 that functions as the outlet flow sealing element when in closed position, while lower reed 510 functions as a damper, a kicker, a pusher or a "windshield" for the upper reed, depending on the phase of operation and the operating speed, as will be described in detail below. For FIGS. 2 through 26, the thickness of the reeds is exaggerated for clarity of illustration and explanation. In FIG. 27 and the later figures, the reed thicknesses are drawn more realistically. Upper 504 and lower 510 reeds may be identical in shape and thickness and material composition, or lower reed 510 may be thicker and thus stiffer than upper reed 504.

Figure 3:
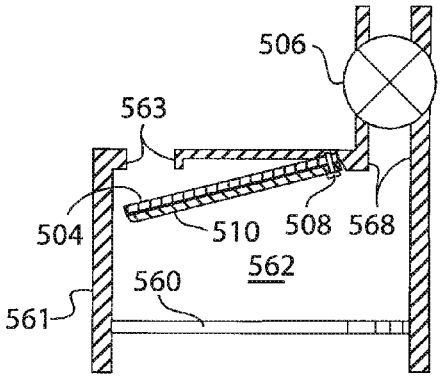
FIG. 3 is a cross-sectional view of the first embodiment taken along line 3-3 of FIG. 1, with the thickness of the reeds exaggerated for illustration purposes, and showing the reeds not occluding the outlet 563.
Figure 4:
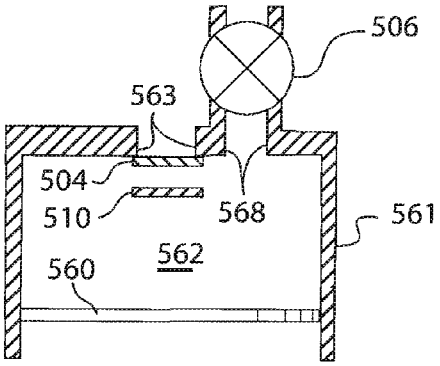
FIG. 4 is a cross-sectional view of the first embodiment similar to FIG. 2, but showing the reeds occluding the outlet 563.
Figure 5:
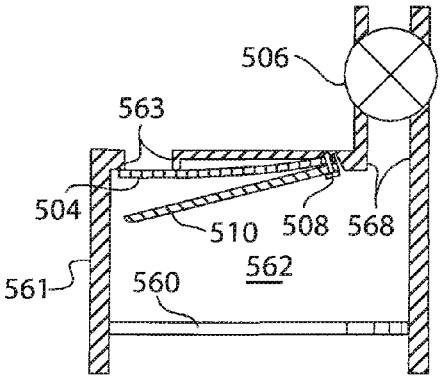
FIG. 5 is a cross-sectional view of the first embodiment similar to FIG. 3, but showing the reeds occluding the outlet 563.

The outlet double reed assembly is attached to the top of cylinder 561 at one end (i.e. the connector end) with fastener 508 at an angle, so that the cantilevered free ends of reeds 504 and 510, in their relaxed, equilibrium, neutral positions, extend down into cylinder 561 as shown best in FIG. 3. As shown in the Figures, when the first flexible member is unstressed, it is located within the expansion chamber spaced from the outlet, and when the first flexible member is stressed or resiliently biased to the closed position adjacent it occludes the outlet. The second flexible member is also located within the expansion chamber and spaced from the outlet when it is unstressed/unbiased. The location of the attachment point together with the angle of attachment are chosen so that when the free end of reed 504 is pressed upwards against the mouth of outlet 563 of cylinder 561, the free end lies parallel to the upper surface of cylinder 561, as shown in FIGS. 4 and 5, so that a good seal is formed to prevent the flow of working fluid from within expansion chamber 562 through outlet 563. As is known in the art, this angle may be computed from the theory of cantilevered bending beams. In order to prevent failure from fatigue, the maximum stress experienced by reeds 504 and 510 at their point of maximum bending is designed to be less than the fatigue limit for the reed material. A readily available and inexpensive material that is suitable is type-301 stainless steel with full hard spring temper. By design, the lengths of reeds 504 and 510 are as long as feasible given the diameter of cylinder 561, in order to minimize their maximum stress. For a cylinder diameter of about 70 mm, an outlet port diameter of about 8 mm, and a reed length of about 50 mm, a thickness of reeds 504 and 510 of about 0.4 mm leads to a maximum stress well below the limit for 301 stainless steel throughout the operating cycle of the engine.

The double reed outlet valve of this embodiment may be used in conjunction with a wide variety of inlet valve designs. Accordingly, a generic inlet control device 506 is shown. The inlet control device 506 may be, for example, a sliding D valve, a poppet valve, a rotating Corliss type of valve, a rotary sleeve valve, or any other conventional type of steam engine or pneumatic motor inlet valve or variable porting element capable of admitting pressurized working fluid into expansion chamber 562, either at predetermined phases in the engine cycle or in response to predetermined pressure conditions, as is known in the art.

Piston 560 in the first embodiment is a conventional axially reciprocating piston driven by connecting rod 569 attached to flywheel 570, in a manner well known in the art. Alternative mechanisms, such as a wobble piston will be described later, but any movable element that causes expansion chamber 562 to vary cyclically in volume between a minimum volume at TDC (Top Dead Center) and a maximum volume at BDC (Bottom Dead Center) would be suitable for this engine, it is useful, although not required, that the range of motion of the movable element allows it to make contact with the exhaust reeds. Cylinder 561 preferably has a rigid cylindrical shape, as is assumed in the detailed description to follow, but could also be a flexible bellows like structure with piston 560 fixedly attached at one end. Most generally, the first embodiment works for almost any pressure driven engine that ingests a working fluid at one pressure from an inlet 568 controlled via inlet control device 506, and expels that working fluid at a lower pressure through an outlet 563 while at the same time piston 560 oscillates between the TDC and BDC positions.

An advantage produced by having a double reed for the outlet is that the spring force resisting closure of the outlet valve can be made much stronger than the spring force tending to open the outlet valve. This is because the closing force must bend both reeds 504 and 510, while for opening only 504 is involved. This allows the engine to run at higher speed before the onset of aerodynamic closure of reed 504 on the up-stroke, by virtue of the "windshield" action of reed 510, while allowing nearly complete expansion of the working fluid in the expansion chamber on the down-stroke due to the relative weakness of the opening spring force of outlet reed 504, so that the working fluid pressure is assured to closely match the pressure outside port 563 at the point that reed 504 opens. A further advantage of the double reed valve is that the character of the exhaust valve operation changes automatically with changes in speed, as will be discussed in more detail below, so that greater efficiency is attained at high speed, while greater torque is produced at low speed and at startup.

Operation of Double Reed Exhaust Valve

The operation of this embodiment changes character, depending upon the speed and direction of the working fluid flow in the vicinity of the outlet reeds and the speed with which the surface of piston 560 encounters lower reed 510. In normal operation of the first embodiment, there is a first speed threshold, corresponding to the transition between "slow aerodynamic closure" of the outlet valve to "collisional closure" of the outlet valve, and a second speed threshold, corresponding to the transition between "collisional closure" of the outlet valve to "rapid aerodynamic closure" of the outlet valve. In embodiments for which the range of motion of piston 560 does not allow it to contact the exhaust reeds, there is only one speed threshold corresponding to the transition from "slow aerodynamic closure" to "rapid aerodynamic closure".

Collisional Closure

Figure 7:
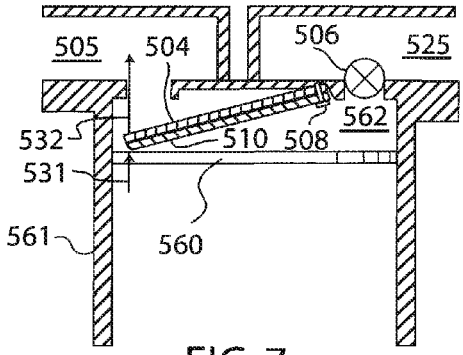

Immediately after the time in any given engine cycle that piston 560 first makes contact with the pair of reeds, as illustrated in FIG. 7, the tip of each reed acquires an upward velocity indicated by arrow 532 that is, to excellent approximation, twice the upward velocity indicated by arrow 531 of the point of contact with piston 560 at the time of impact. Under the assumption that aerodynamic forces on the reeds are negligible, as is appropriate for speeds well below the rapid aerodynamic closure threshold, the motion of both reeds approximately follows the Euler-Bernoulli theory for the lowest mode vibration of a cantilevered beam, and $\Delta y$, the amplitude of the tip motion, to good approximation, would be given by the ratio of V, the initial velocity of the tip of each reed, to $2\pi f_0$, where $f_0$ is the natural resonance frequency of the lowest mode of vibration for a given reed, according to the following expression.

$$\Delta y = \frac{V_{immediately-after-collision}}{2\pi f_0}$$

Figure 8:
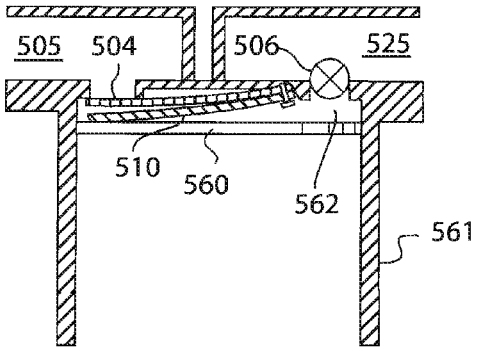
Figure 9:
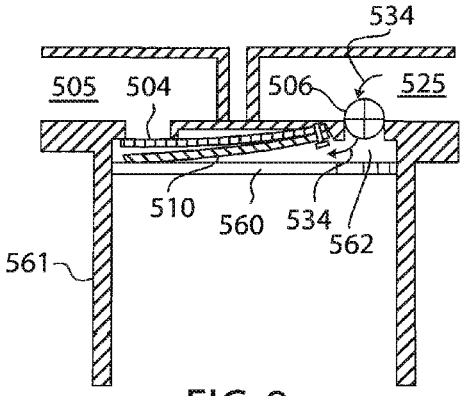

The threshold of "collisional closure" corresponds to the case that the magnitude of the upward tip velocity, V, immediately after collision is great enough that the amplitude of tip motion for upper reed 504 is greater than its distance to the top of cylinder 561 where the outlet is located, so that as the tip of reed 504 approaches the top of cylinder 561, the increasingly rapid outrush of working fluid from the increasingly narrow outlet from the cylinder causes the upper reed to experience a suction force tending towards the outlet and thus force it closed. This upward force on reed 504 persists as long as the pressure within expansion chamber 562 exceeds the pressure in outlet duet 505 by enough that the differential pressure force is greater than the resilient opening force of reed 504 in its bent, closed position. With the continued upward motion of piston 560, upper reed 504 remains forced closed, while lower reed 510 ends up pressing against the top of piston 560, as shown in FIG. 8.

Collisional Closure Operating Cycle

Figure 6:
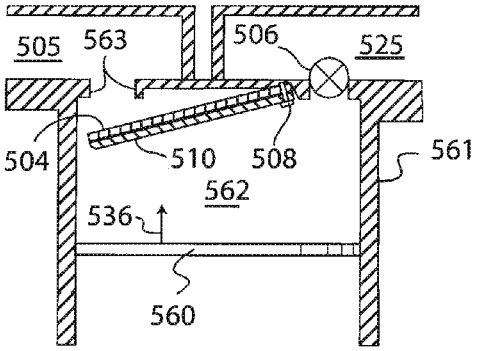
FIGS. 6-11 are cross-sectional views of the first embodiment showing a representative sequence of configurations of the moving parts under collisional closure operational conditions.
Figure 10:
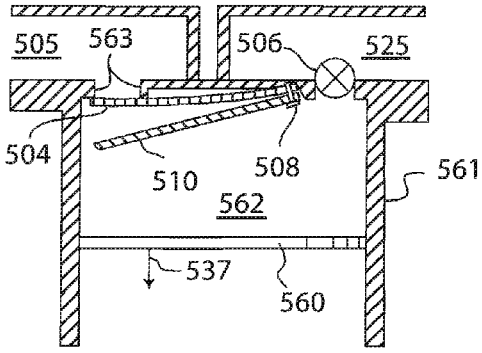

The description of a typical "collisional closure" cycle of engine operation starts, arbitrarily, from the configuration shown in FIG. 6. Piston 560 is moving upwards as indicated by arrow 536 and both upper reed 504 and lower reed 510 are in their relaxed, neutral, equilibrium positions. The upward motion of piston 560 continues until it collides with, or bumps, the outlet reeds. If there is a small spacing between upper reed 504 and lower reed 510, the piston will first bump the lower reed, which will in turn bump the upper reed. In any case, immediately after the collision illustrated in FIG. 7, both upper reed 504 and lower reed 510 acquire an upward motion, and they both initially move ahead of piston 560. Under "collisional closure" conditions, upper reed 504 moves all the way to its closed position and stays there, while lower reed 510 may bounce back and forth between upper reed 504 and the top of piston 560, but soon ends up bent and pressing against the top of piston 560, as shown in FIG. 8. Then, with piston 560 near its TDC position, and the pressure in expansion chamber 562 high enough to keep reed 504 in its closed position, inlet control device 506 is opened, allowing working fluid to flow into expansion chamber 562, as indicated by arrows 534 in FIG. 9. The opening of the inlet valve may be either responsive to the cylinder pressure, as will be specifically described in detail below, or may be responsive to the phase of the engine cycle, as with a sliding D valve or rotating Corliss type of valve as is well known in the art. The open state of valve 506 is indicated by a circled +, while the closed state is indicated by a circled X. The maintenance of the pressure within expansion chamber 562 by the supply of high-pressure fluid from inlet duct 525 passing through inlet control device 506 then maintains reed 504 closed as piston 560 descends from TDC. Lower reed 519 does not experience the differential pressure force felt by reed 504. As a result, once piston 569 has dropped sufficiently, reed 510 returns to its neutral, unstressed position, and the configuration of reeds 504 and 510 becomes as shown in FIG. 10 with the piston moving downwards as indicated by arrow 537. At some point in the descent of piston 560, the inlet valve is closed and the supply of pressurized working fluid to the expansion chamber ceases.

Figure 11:
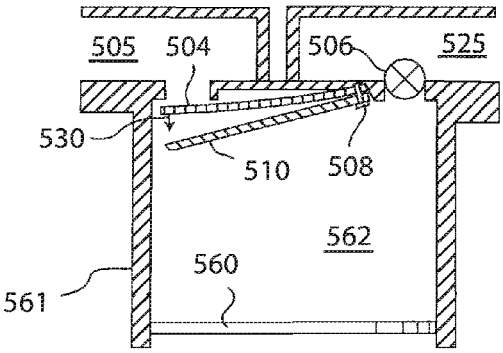

The configuration of reeds 504 and 510 shown in FIG. 10 is maintained until the pressure within expansion chamber 562 falls sufficiently close to the pressure in outlet duct 505 that the resilient opening force of reed 504 causes it to spring open. An illustration of the configuration immediately after such a pressure has been reached is shown in FIG. 11. Here lower reed 510 is near its neutral position and essentially stationary, while upper reed 504 is in the process of opening and its tip is descending, as indicated by arrow 530 away from its closed position at the top of cylinder 561. Under nominal conditions, this event occurs with piston 560 near its BDC position, although at lower supply pressure conditions, this event occurs before the BDC position is reached. In the absence of lower reed 510, once released from its closed position, reed 504 would have a tendency to undergo a single cycle of harmonic, oscillation and return very close to its closed position. Indeed this tendency is exploited in the Harmonic Engine of U.S. Pat. No. 7,603,858. When piston 560 is moving upwards, in the absence of reed 510 there results the tendency for outlet reed 504 to be prematurely closed at some operating speeds by the aerodynamic force of outrushing working fluid as it approaches its closed position. Here lower reed 510 acts to prevent such premature closure of upper reed 504. As upper reed 504 returns to its neutral position, as illustrated in FIG. 11, it slaps against lower reed 510. It has been found that this slapping collision between reeds 504 and 510 is highly inelastic. As a result, the presence of the preferably stiffer reed 510 greatly reduces the kinetic energy of motion of reed 504, and both reeds tend to end up nearly at rest close to their neutral positions as shown in FIG. 6, ready to repeat the process described in this section in the next engine cycle as piston 560 continues to execute its cyclical motion.

Low Speed Operational Cycle

Figure 12:
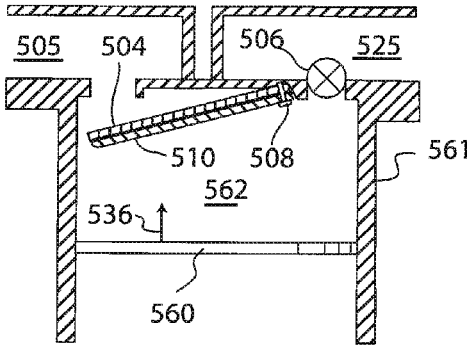
FIGS. 12-17 are cross-sectional views of the first embodiment showing a representative sequence of configurations of the moving parts under slow aerodynamic closure operational conditions.
Figure 13:
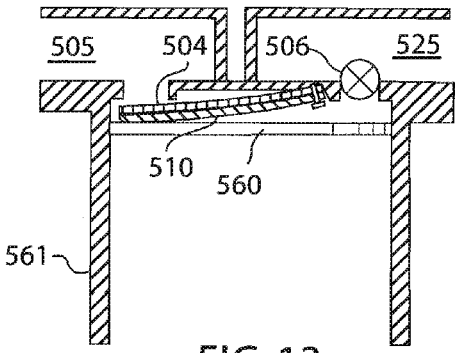
Figure 14:
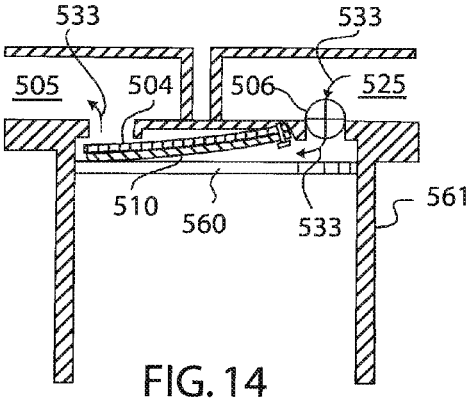
Figure 15:
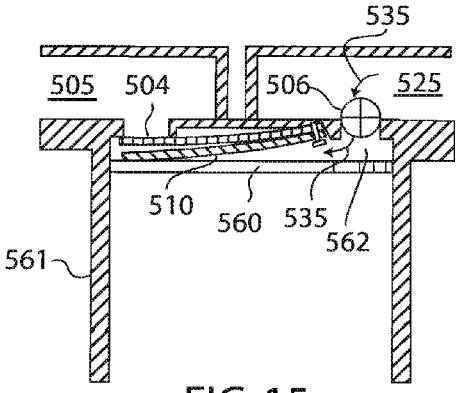
Figure 16:
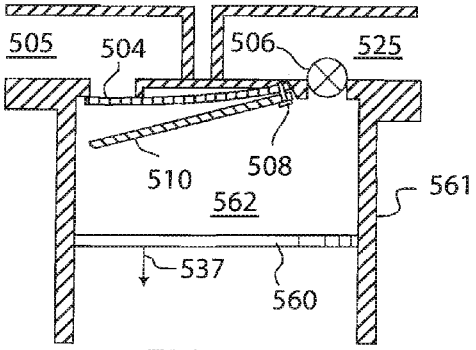

The operation of the double reed engine under low speed conditions (below the collisional closure threshold) is different, and follows the sequence of configurations shown in FIGS. 12 through 17. A given cycle starts arbitrarily with both reeds in their neutral, relaxed position, and the piston moving upwards as indicated by arrow 536, as shown in FIG. 12. After low speed impact between piston 560 and reeds 504 and 510, with the amplitude, Δy, following impact insufficient to close upper reed 504, neither reed moves very far from the surface of the piston before the pistons continued motion again brings it into contact with the reeds. Thus, at low speed, both upper reed 504 and lower reed 510 remain in near contact with the upper surface of piston 560 as the piston moves upward towards its TDC position, as illustrated in FIG. 13. After inlet control device 506 is opened, which may be either before or after piston 560 has reached its TDC position, the flow of working fluid from the high pressure region within inlet duct 525, through the inlet, through the expansion chamber, around upper reed 504 and out through exhaust duct 505, as indicated by the three arrows 533 shown in FIG. 14, produces an aerodynamic force that causes an upward directed suction force on reed 504. Because this flow is generally parallel to the surface of piston 560, there is very little aerodynamic force on lower reed 510, while because of the outrushing flow of working fluid through outlet 563, there is a significant force on upper reed 504. Once this force exceeds the opposed force of resilience of upper reed 504 that tends to open it, the upper reed closes, as shown in FIG. 15, and the flow of working fluid directly from inlet duct 525 to outlet duct 505 ceases, and upper reed 504 is held closed by the pressure differential across it, while lower reed remains in its flexed position pressed against the top of piston 560 as long as the piston is close enough to its TDC position. Working fluid continues to flow into expansion chamber 562, indicated by arrows 535, as long as the inlet valve is open and the volume of expansion chamber 562 is increasing. Then, as piston 560 descends as indicated by arrow 537, lower reed 510 is left in its neutral, unstressed configuration, and the configuration of reeds 504 and 510 is as shown in FIG. 16. After inlet control device 506 is closed, the flow of working fluid into expansion chamber 562 ceases, and with increase in the volume of the chamber, the pressure of the expansible working fluid drops.

Figure 17:
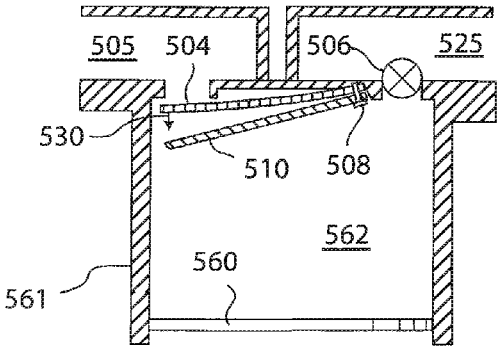

The configuration of the reeds shown in FIG. 16 is maintained until the pressure within the expansion chamber drops sufficiently to allow upper reed 504 to open, as illustrated in FIG. 17. As described above, the slapping of upper reed 504 against lower reed 510 rapidly damps the kinetic energy of both reeds, so that they end up essentially at rest in their neutral position, ready for the next engine cycle to begin, as shown in FIG. 12.

Rapid Aerodynamic Closure Cycle

Figure 18:
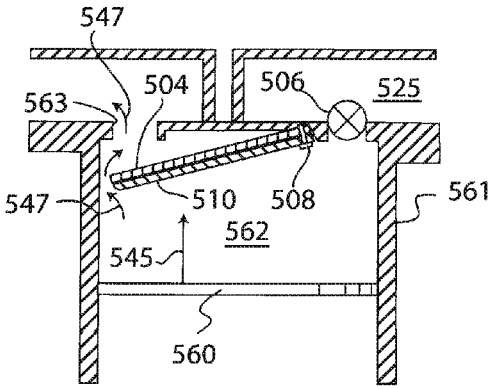
FIGS. 18-23 are cross-sectional views of the first embodiment showing a representative sequence of configurations of the moving parts under fast aerodynamic closure operational conditions.
Figure 19:
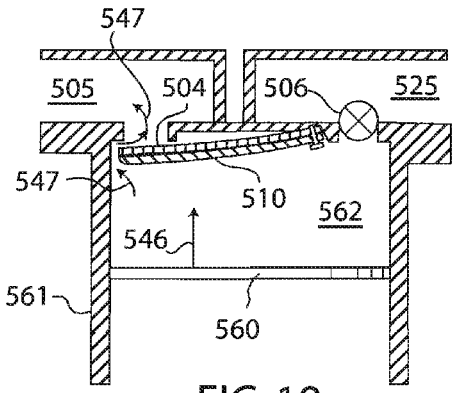
Figure 20:
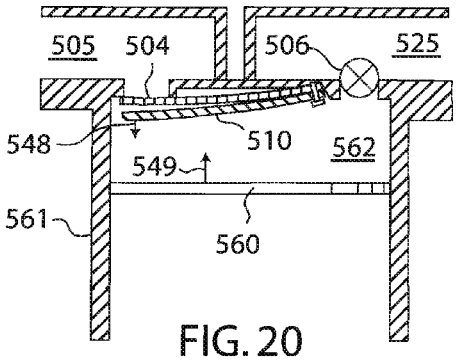
Figure 21:
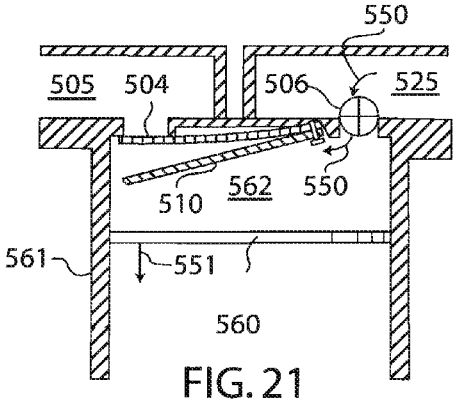
Figure 22:
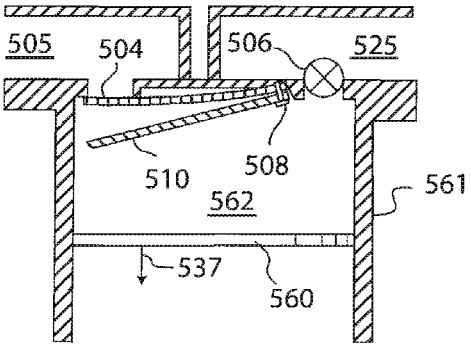
Figure 23:
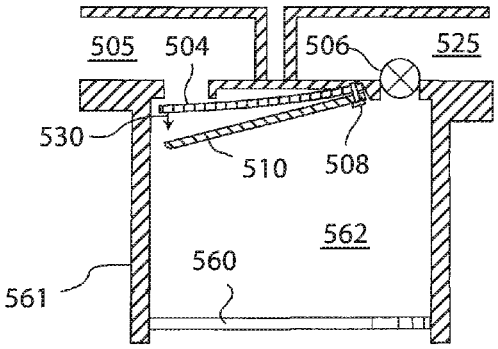

The threshold for "rapid aerodynamic closure" of the outlet valve corresponds to the case, illustrated in FIGS. 18 and 19, that the upward speed 545 and 546 of piston 560 is sufficiently high that the flow of working fluid 547 around reeds 504 and 510 and through outlet 563 exerts sufficient aerodynamic force on the pair of reeds 504 and 510 that they are both bent (i.e. resiliently biased) towards the closed position. Then, once upper reed 504 occludes outlet 563, the aerodynamic flow around lower reed 510 essentially ceases, and lower reed 510 drops towards its unstressed position, as indicated by arrow 548 in FIG. 20, while piston 560 continues to ascend towards TDC as indicated by arrow 549. Depending on the height of piston 560 at TDC, it may or may not make contact with lower reed 510. It is appreciated however, that despite the lower reed not contacting the piston, it is the upward movement of the piston that resiliently biases the lower reed and moves the upper read to the closed position. Indeed, in a configuration for which the lowest extent of lower reed 510 is above TDC, there will not be a "collisional closure" range of operation at all, and the engine will go from the "slow aerodynamic closure" described above, directly to the "rapid aerodynamic closure" described here as the operational speed increases. In any case, as piston 560 approaches TDC, and the inlet valve is opened, the supply of pressurized working fluid keeps upper reed 504 closed for the subsequent filling of expansion chamber 562 with inlet flow 550 as the piston descends from TDC, as shown in FIG. 21. Then, following the closure of inlet valve 506, with continued descent 537 of the piston, as indicated in FIG. 22, the pressure of the working fluid drops until the pressure differential across upper reed 504 is no longer sufficient to keep it closed. Once the pressure has dropped sufficiently, upper reed 504 springs open, as indicated by arrow 530 in FIG. 23. As described above for lower speed operation, upper reed 504 slaps against lower reed 510 and both end up near their unstressed position ready for the next cycle of operation.

Double Reed with BDC Vent Ports

Figure 24:
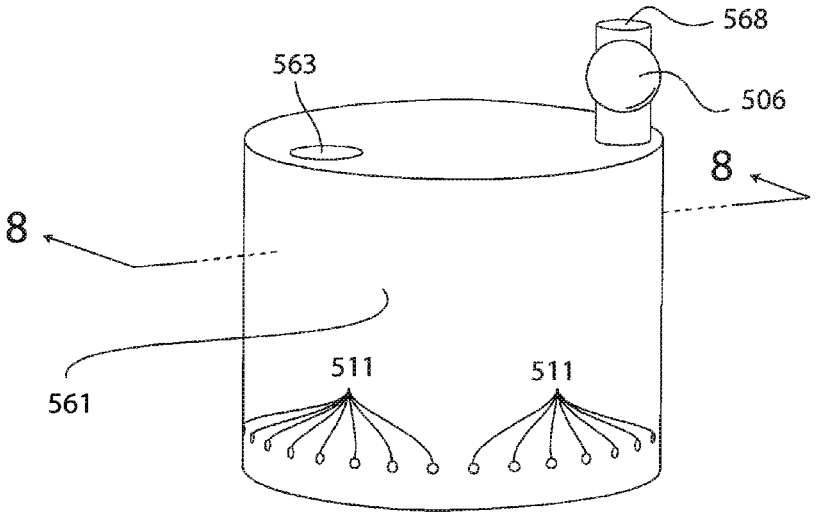
FIG. 24 is a perspective view of a second embodiment that has a number of vent ports near BDC.
Figure 25:
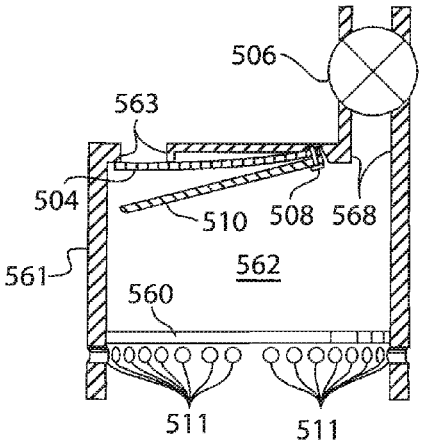
FIGS. 25 and 26 are cross-sectional views of the second embodiment showing two configurations of the moving parts, with FIG. 25 showing the reeds occluding the outlet and FIG. 26 showing the reeds not occluding the outlet.

One of the requirements for normal operation of the double reed engine is that it is necessary for the pressure within the expansion chamber to drop sufficiently to allow upper reed 504 to spring open. If the pressure is too high as piston 560 approaches BDC, then upper reed 504 fails to open, and the engine may stall. This problem can be avoided by limiting the magnitude of the supply pressure or by limiting the phase duration that the inlet is open. In order to allow higher pressure and higher power operation, as well as a wider range of operating speeds, a second embodiment provides a number of BDC vent ports 511 around the circumference of cylinder 561 near one end, as shown in FIGS. 24-26. Here, in the event that the pressure is so high in the configuration shown in FIG. 25 that expansion alone at the point that piston 560 reaches BDC is insufficient to drop the working fluid pressure enough to allow upper reed 504 to open, as piston 560 closely approaches its BDC position, as shown in FIG. 26, working fluid within expansion chamber 562 is free to vent out through ports 511, as indicated by arrows 552, and thus the pressure can drop sufficiently to allow upper reed 504 to spring open. As before, with upper reed 504 slapping against lower reed 510, both can be left near their neutral positions after upper reed 504 opens. In this embodiment, the pressure immediately outside vent ports 511 is the same as the pressure just outside outlet 563, either because both are open to the atmosphere, or because both share a common exhaust manifold (not shown).

Multi-Petal, Double Reed Exhaust Valve

Figure 28:
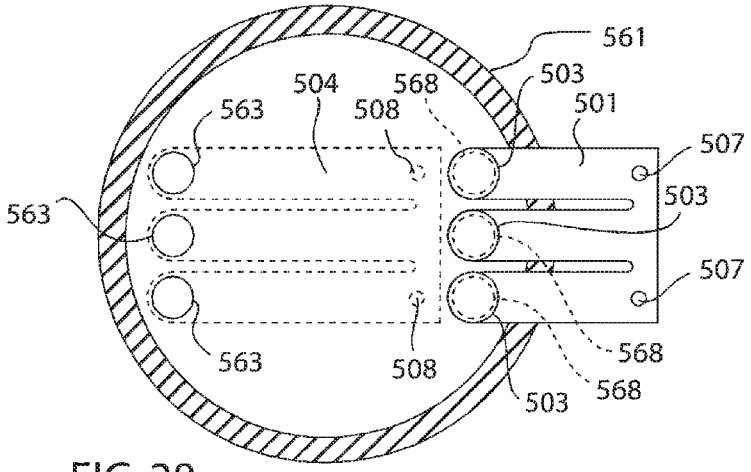
FIG. 28 is a partial top view of the third embodiment showing the inlet and outlet valves with a portion of the cylinder, taken along the line of sight A-A shown in FIG. 28.

Although the double reed exhaust valve may be used with any number of inlet valve types, a normally open, self-biasing reed is particularly well suited for the inlet valve and may be used with or without BDC vent ports. This embodiment with BDC vent ports is illustrated in FIG. 27, and shows both inlet and outlet reeds having three petals or prongs covering three ports, as best seen in the top view shown in FIG. 28. The inlet valve consists of resiliently self-biasing inlet reed 501, and a head consisting of a lower reinforcing disk or striker pad 502 and upper reinforcing disk or pad 503 attached at the free end of reed 501. A basher 509 attached to piston 560 is positioned so that it will force inlet reed 501 to open as piston 560 approaches TDC. Inlet reed 501 is attached at an inclined angle to the wall of inlet header duct 525 at one end with fastener 507, so that the free end of reed 501 in its relaxed, equilibrium, neutral position, extends up into inlet header duct 525 away from the expansion chamber within cylinder 561. The angle of attachment is chosen so that when the free end of inlet reed 501 is pressed downwards against the mouth of inlet 568 of cylinder 561, the free end lies parallel to the plane of the inlet to cylinder 561, so that a good seal is formed against the inrush of pressurized working fluid from the inlet header duct 525 into expansion chamber 562 within cylinder 561. As is known in the art, the angle of attachment that provides for such sealing of the free end of reed 501 may be computed from the theory of bending beams. Inlet reed 501 may be fashioned of full hard spring tempered type 301 stainless steel. The upper reinforcing pad 503 prevents dimpling and damage to reed 501 by the high pressure of the working fluid in inlet header 525 as reed 501 is pressed against inlet 568 to cylinder 561. The lower reinforcing striker pad 502 prevents damage to reed 501 as it is bumped open by basher 509.

An inlet valve range of motion limiter 526 is located within inlet header duct 525. The function of this limiter is to prevent inlet reed 501 from swinging excessively far in the upwards direction. Under very high-speed operation, the collision of basher 509 with striker pad 502 can kick the inlet valve hard enough that without limiter 526, inlet reed 501 would be bent excessively and could be damaged.

Operation of Multi-Petal, Double Reed Exhaust Valve Engine

Figure 29:
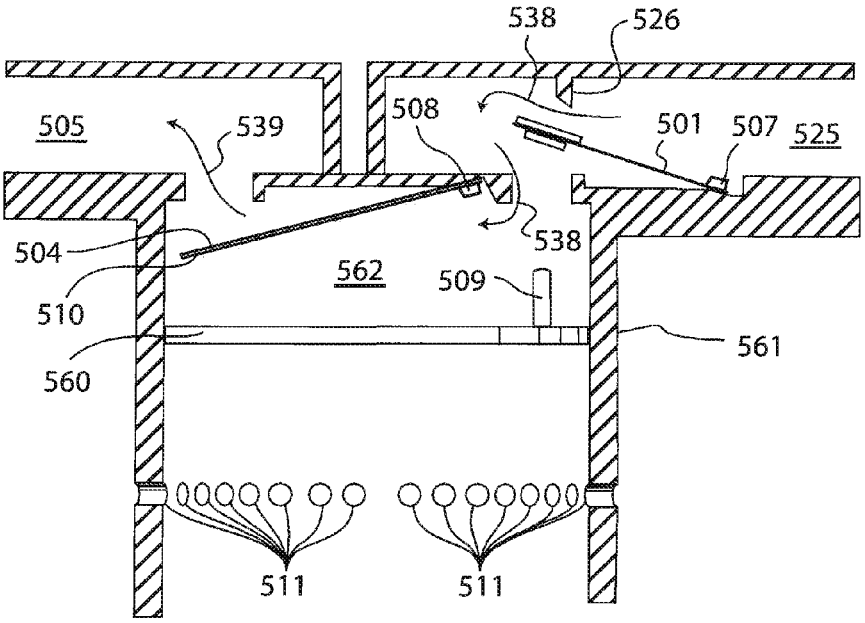
FIGS. 29-34 are cross-sectional views of the third embodiment showing a representative sequence of configurations seen during the operation of this embodiment.

The operation of the multi-petal/prong double reed exhaust valve embodiment is best explained by following the course of events in a cold startup situation. In order to start the engine, it is best to have piston 560 positioned sufficiently above BDC that vent ports 511 are not about to be exposed. The stationary configurations shown in FIG. 27 and FIG. 29 meet these requirements. Then, as pressurized working fluid is supplied through inlet duct 525, a flow of working fluid develops, as illustrated in FIG. 29, that passes around the head of the inlet valve, as indicated by arrows 538, passes through expansion chamber 562 and exits as indicated by arrow 539 through the outlet of the expansion chamber and exhaust duct 505. By virtue of the similar size of the inlet ports 568 and the outlet ports 563, the pressure in the expansion chamber in this startup process approaches, to good approximation, a value midway between the pressure in inlet duct 525 and outlet duct 505. As a result, the aerodynamic force tending to close inlet reed 501 is approximately equal to the aerodynamic force tending to close outlet reed 504. However, since the mass of the head of the inlet valve is greater than the mass of the tip of outlet reed 504, the outlet reed moves to its closed position faster than does the inlet reed.

Figure 30:
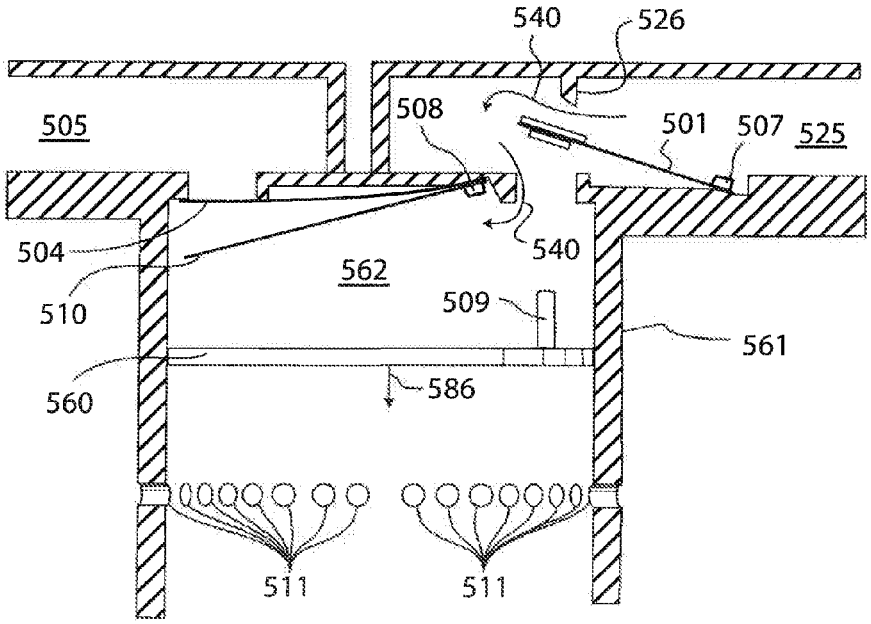
Figure 31:
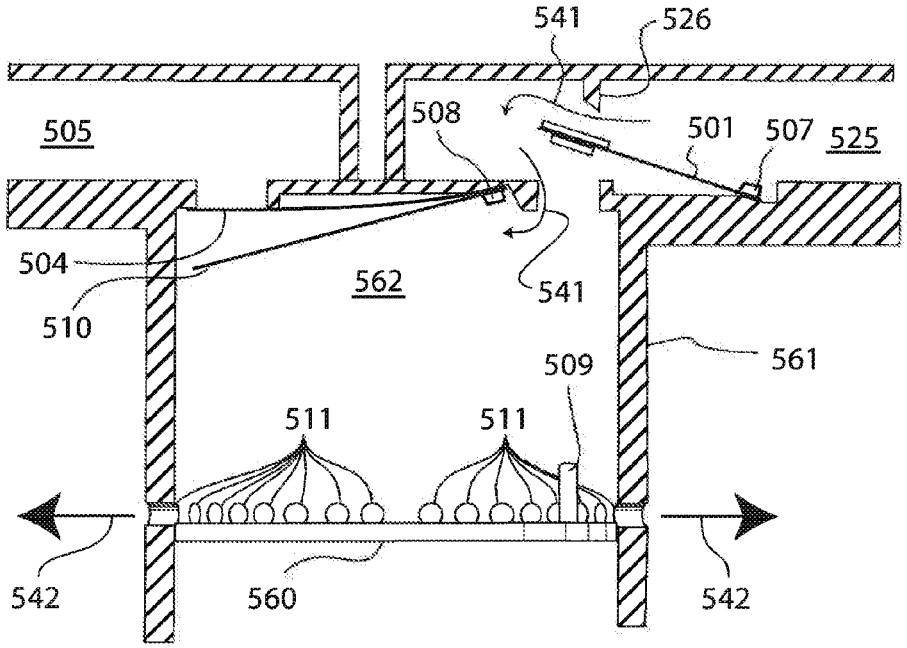
Figure 32:
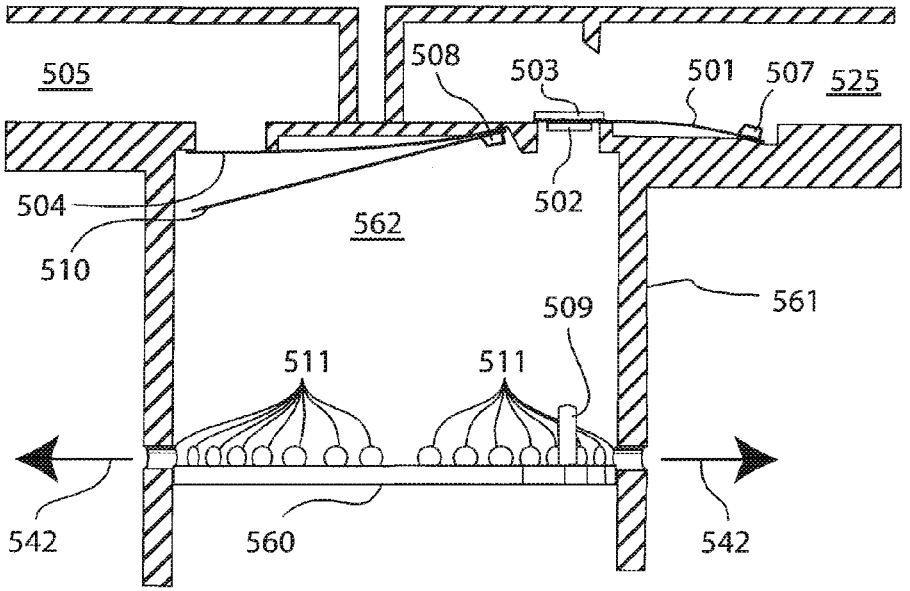
Figure 33:
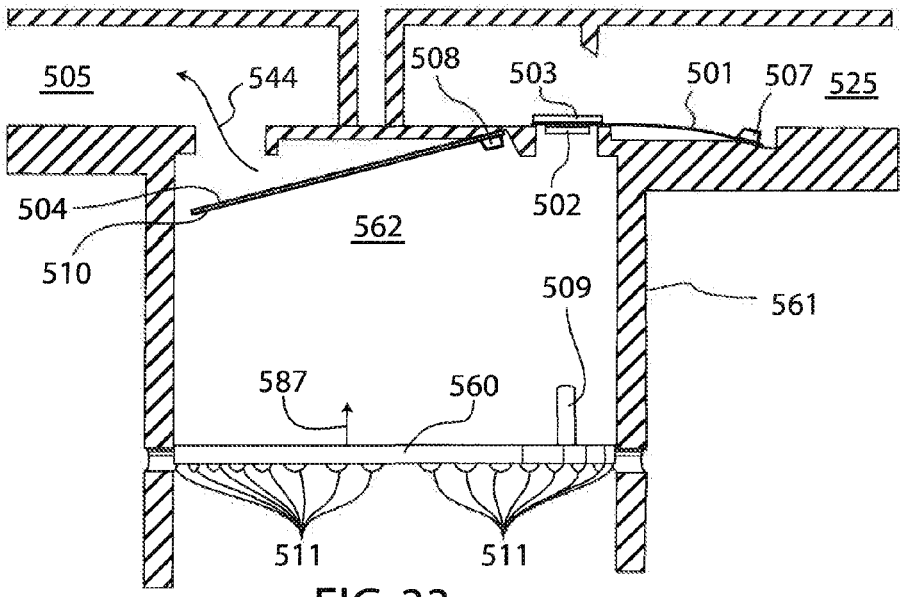

With the closure of outlet reed 504, the flow out of the expansion chamber indicated by arrow 539 ceases, and the configuration of the engine is as illustrated in FIG. 30. Now, with the flow into the expansion chamber indicated by arrows 540 greatly reduced, under startup or low speed operation, the aerodynamic force is insufficient to close inlet reed 501 and it remains open, allowing the full pressure of the working fluid in inlet duct 525 to act on piston 560. As a result, piston 560 begins to descend, as indicated by arrow 586. At startup or very low speed, the inlet valve remains open almost through the remainder of the down-stroke, thus allowing the full supply pressure to act on the piston. Then, as expansion chamber 562 gains access to vent ports 511 by the descent of piston 560, very rapid flow, indicated by arrows 541 in FIG. 31, ensues around the inlet valve, and very rapid venting, indicated by arrows 542, ensues out of the exposed vent ports 511. The rapid flow, indicated by arrows 541, causes inlet reed 501 to bend to its closed position, and after closure, the flow into expansion chamber 562 from the supply ceases, and the configuration illustrated in FIG. 32 results. With the cutoff of further pressurized working fluid from the inlet, continued venting from the BDC vent ports 511, as indicated by arrows 542, causes the pressure in expansion chamber 562 to decrease. As described earlier, outlet reed 504 springs open at the point that the pressure drops close enough to the pressure in outlet duct 505. After this, the configuration is as illustrated in FIG. 33, with exhaust of working fluid, as indicated by arrow 544, out through exhaust duct 505 as piston 560 ascends from BDC, as indicated by arrow 587.

Figure 34:
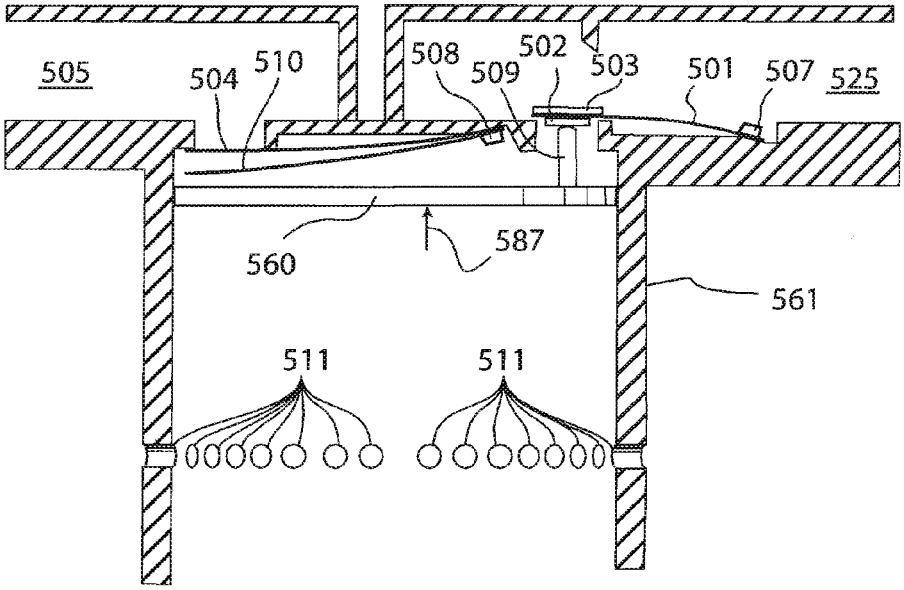

For the upstroke, the operation of the double reed exhaust valve is as described in connection with FIG. 6-11, 12-17, or 18-23, depending on the speed of the piston. A feature of the combination of the basher and inlet reed valve in this embodiment is that the inlet valve is assured to be forced open before piston 560 reaches TDC, as indicated in FIG. 34. Thus, if the engine speed is too slow for collisional closure of the outlet valve, as described in connection with FIGS. 12-17, the contact of basher 509 with striker pad 502 forces inlet reed 501 to open, and if upper reed 504 is not already closed, the aerodynamic force of the working fluid flow directly from inlet duct 525 to outlet duct 505 will quickly force it closed as described earlier in connection with FIG. 14.

As the engine speed increases, the threshold speed for which inlet reed valve 501 no longer remains open throughout the down-stroke is reached when the aerodynamic force of the working fluid flow around the inlet valve shown by arrows 540 in FIG. 30 is sufficient to force inlet reed 501 to bend closed. Since the cyclic motion of piston 560 is approximately sinusoidal, this threshold is first reached at a point that piston 560 is near the half way position between TDC and BDC shown in FIG. 30. With continued increase in the engine operating speed, the threshold flow speed for inlet reed closure is reached before piston 560 reaches the halfway position between TDC and BDC. At any speed, however, the inlet is forced to remain open until the piston has dropped sufficiently far below TDC that the top of basher 509 drops below the upper mouth surface of inlet 568.

At speeds above the threshold for "collisional closure" of the outlet valve, the velocity acquired by reed 504 after the collision of piston 560 with the pair of reeds 504 and 510 causes reed 504 to be impelled close enough to closing that the aerodynamic force of outrushing working fluid forces it to close completely and to keep it closed as described above in connection with FIGS. 6-11. Under these conditions, outlet reed 504 may be closed earlier than the time that inlet reed 501 is forced to open by the contact of basher 509 with striker pad 502. As a result, there will be a degree of compression of the working fluid prior to the opening of the inlet valve. This compression process increases the efficiency of operation of the engine, as there is no longer as much "lost work" in the process of pressurizing the expansion space with high-pressure working fluid from the high-pressure supply. With increasing engine speeds between the collisional closure threshold and the fast aerodynamic threshold described earlier, the phase at which the outlet valve is closed occurs sooner, thus increasing the engine efficiency. As the engine speed increases beyond the fast aerodynamic closure threshold, compression of the working fluid as the piston approaches TDC may become sufficient to raise the pressure above that of the supply pressure. A particular advantage of the normally open reed for the inlet valve is that at high speed, for which the compression of the working fluid could otherwise raise its pressure far above the inlet supply pressure, the reed inlet valve can be automatically forced open by this pressure spike without the direct mechanical collision with basher 509. At full engine speed, no mechanical collisions need to be involved for either the closure of the outlet reed or the opening of the inlet reed. This purely aerodynamic closing of the outlet valve and opening of the inlet valve leads to lower stress concentration in the reeds, and allows for greater reliability of the engine. In summary, the ramification of this process is that the engine produces a higher torque at low speed, which is helpful for starting up, but not as efficient as with the normal full speed operation, and higher efficiency at high speed in addition to higher reliability.

Inlet Valve Speed Regimes

The phase duration that the inlet valve is open depends on the engine speed. At very low speed, for which the fluid flow pressure on the inlet valve is insufficient to force it closed against the strength of its resilience, as described above, the inlet valve remains open for almost the entire power stroke of the piston. As the engine speed increases, and the threshold for aerodynamic closure of the inlet valve is first reached, the inlet valve closes approximately halfway down the power stroke. As the speed increases further, the inlet valve closure happens increasingly soon before the halfway point is reached, until this aerodynamic closure point would happen before the basher has dropped below the mouth of the inlet port. As the speed is further increased, the presence of the basher prevents closure until after the basher drops enough to allow the inlet valve to close. The actual phase of inlet valve closure at higher speeds depends on the kinetic energy that is imparted to the inlet valve head at the point that it is first opened. The nature of this opening depends on whether the inlet valve is opened by the spike in pressure prior to TDC that is produced by the compression of working fluid after the outlet valve closed, or if the inlet valve is opened by the collision of basher 509 with striker pad 502.

In the case that the bumping of the basher against the striker opens the inlet valve, the determining factor in the open period of the inlet valve is the natural resonant period of the inlet valve relative to the period of time that the top of the basher remains above the mouth of the inlet port. If the natural resonant period is short relative to the basher period, then the inlet valve head bounces multiple times on the bather and remains open for the duration of the basher period plus whatever time is necessary after the last bounce of striker and basher for the inlet had to return to its closed position. This happens at relatively slower engine speeds. On the other hand, if the natural resonant period of the inlet valve head oscillation is long compared to the basher period, then the inlet valve head executes a single oscillation prior to returning to its closed position. This happens at relatively higher engine speeds.

In the case that the pre-TDC pressure spike opens the inlet valve rather than the bumping of basher and striker, the inlet valve is open for a longer time prior to TDC that depends on the magnitude and duration of the pressure spike, but is open for a time after TDC that is determined by the relation between the natural resonant period of the inlet valve and the period that the basher is above the mouth of the inlet, as described in the previous paragraph.

Wobble Piston Embodiment

Another embodiment consists of exploiting wobble actuation of the piston head and asymmetrical placing of the BDC vent ports. In the embodiment shown in FIG. 35, piston head 660 is rigidly connected to a piston rod 661 that is driven in its reciprocating motion by a crank 687 connected to flywheel 685. This so-called wobble piston mechanism is well known in the art of oil-free air compressors. In the embodiment shown here, the basher is attached to the free end of reed 501 rather than to piston 660, and consists of a bolt 519 held in place with a nut 512 and a washer 513. Alternatively, the bolt could be attached to piston head 660 to be the basher, leaving nut 512 as the striker pad as described in the previous embodiment for the purely axial piston movement. In embodiments with the basher mounted on the inlet reed, piston head 660 is made tougher than in embodiments with the basher mounted on the piston head, in order to accommodate the higher stress concentration at the point of contact of the piston head with the tip of bolt 519.

Figure 35:
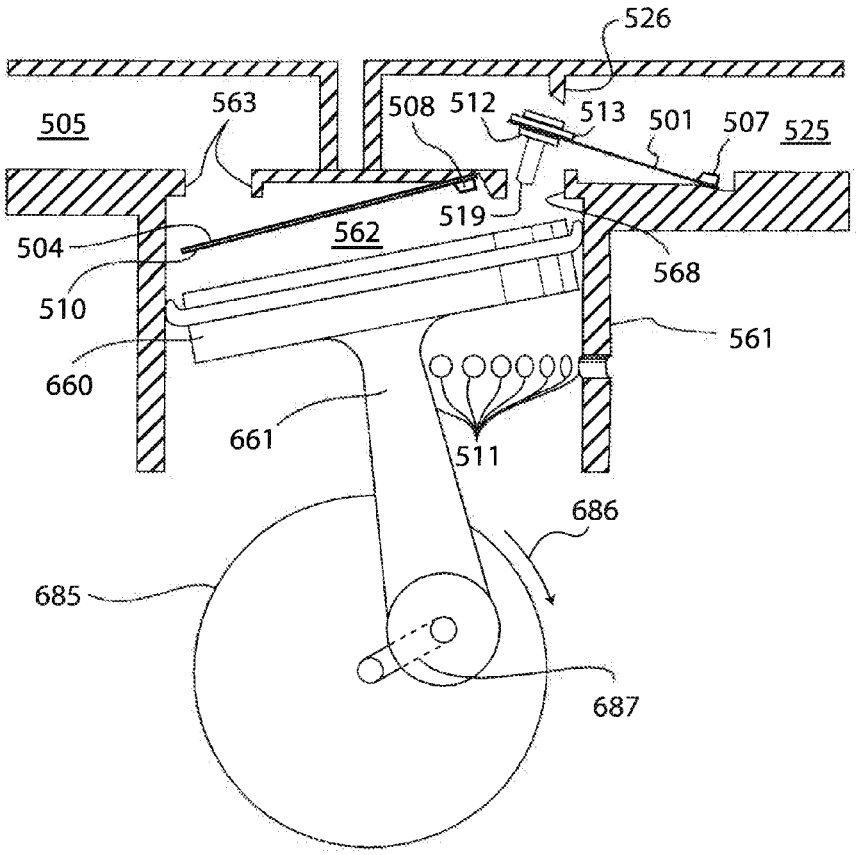
FIG. 35 is a cross-sectional view of the fourth embodiment that has a wobble piston, as well as BDC vent ports and a harmonic inlet valve. The piston in this view is descending from TDC.
Figure 36:
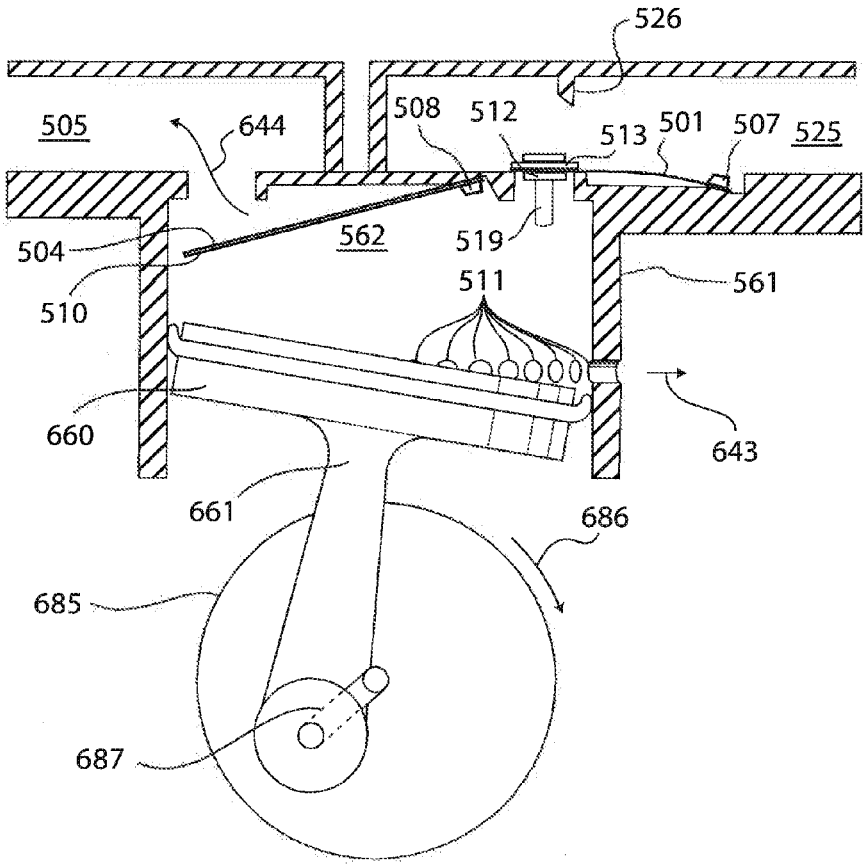
FIG. 36 is a cross-sectional view similar to FIG. 35, but with the piston ascending from BDC.

With the flywheel rotating in a clockwise direction, as indicated by arrow 686 in FIG. 35, piston head 660 is tilted towards the inlet port on the down-stroke as shown in FIG. 35, and tilted towards the outlet on the up-stroke as shown in FIG. 36. Because of this tilting of the piston head, the sequencing of the outlet valve closure prior to inlet valve opening can be assured, even at low operating speed. Also because of this tilting of the piston head, the exposure of outlet ports 511 by piston head 660 can be assured to occur at and after BDC, but not before BDC, and thus the torque per stroke or the power of the engine is improved for a given operating pressure by having the highest feasible pressure on the down-stroke or power-stroke, and the lowest feasible pressure on the up-stroke or exhaust stroke by enabling venting indicated by arrow 643 and exhaust indicated by arrow 644 in FIG. 36.

Figure 37:
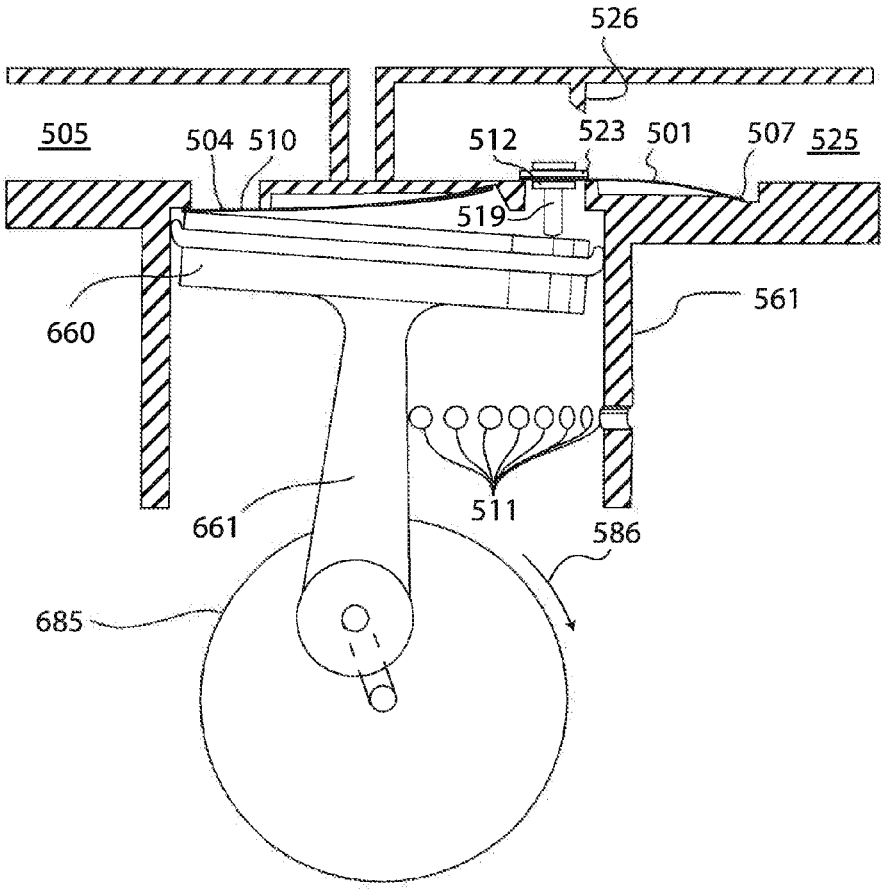
FIG. 37 is a cross-sectional view similar to FIG. 36, but with the left hand side of the piston at its highest position and holding the outlet valve closed and the right hand side of the piston just opening the inlet valve.

Furthermore, with length of bolt 519 such that the inlet is being opened just at the point that the left hand side of the wobble piston head is reaching its apogee, as shown in FIG. 37, it can be assured that even at slow operating speeds, the upper reed 504 is held in its closed position as the inlet valve is opened. In one prototype, with the length of the piston rod 661 of 132 mm, a cylinder bore of 73 mm, and a stroke of 38 mm, the crank phase angle at which the left hand side of the wobble piston head reaches its apogee is 14° before TDC. With the inlet valve just being opened by bolt 519 at this point, (so that the outlet reed will be forced closed at the apogee of the left hand side of the piston) the right hand side of piston 660 remains above the level for which the top of bolt 519 forces the inlet valve to remain open at least from 14° before TDC until 36° after TDC. With a slightly longer bolt, the inlet open phase duration may easily be extended if desired.

Free Double Reed Exhaust Valves

Figure 38:
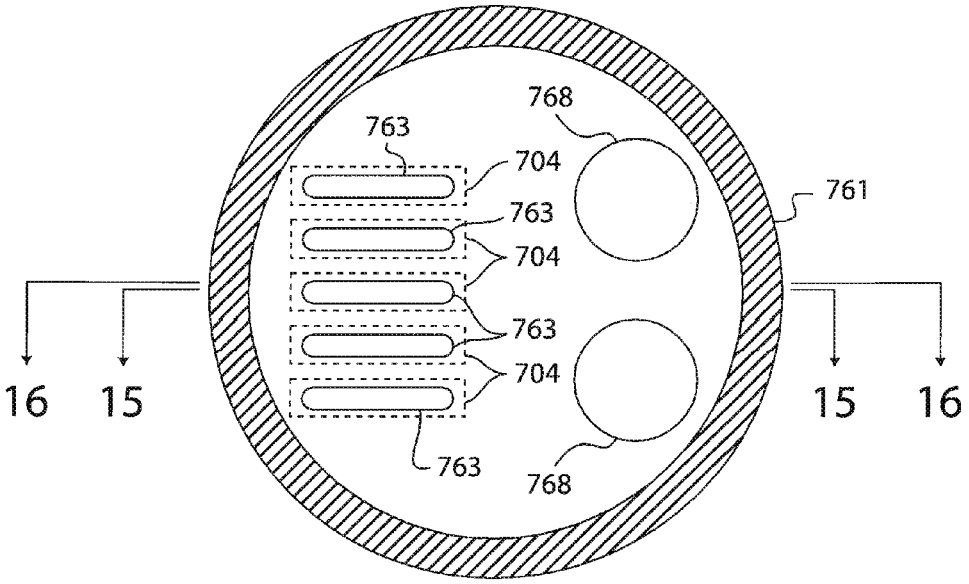
FIG. 38 is a top partial cross-sectional view of an embodiment with a free, but constrained arrangement for the double reeds.
Figure 39:
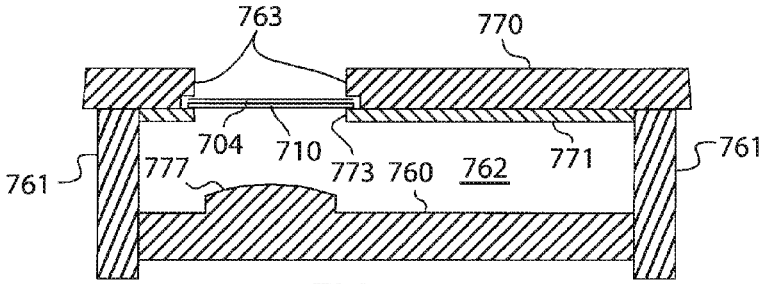
FIG. 39 is a partial side cross-sectional view taken along line 39-39 in FIG. 14, showing the free outlet reeds in their relaxed position.
Figure 40:
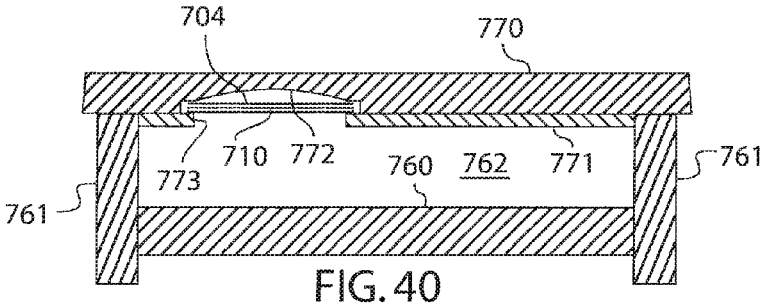
FIG. 40 is a partial side cross-sectional view similar to FIG. 39, showing the free outlet reeds in their closed position.
Figure 41:
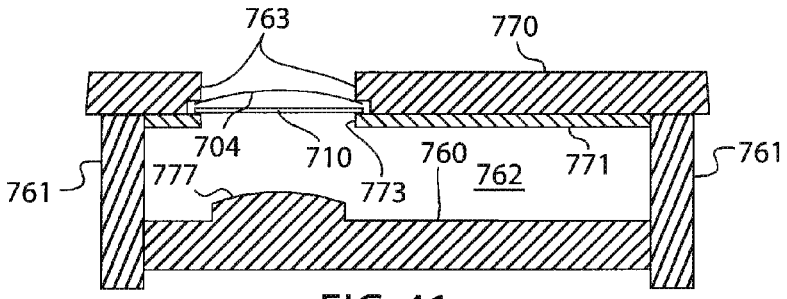
FIG. 41 is a partial side cross-sectional view taken along line 41-41 in FIG. 14, showing the free outlet reeds in their relaxed position.
Figure 42:
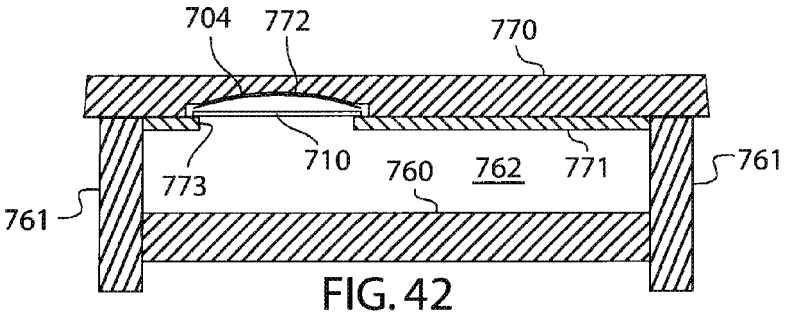
FIG. 42 is a partial side cross-sectional view similar to FIG. 41, showing the free outlet reeds in their closed position.

Another variation on the double reed exhaust valves is illustrated in FIGS. 38-45. Here FIG. 38 is a partial top view of the engine showing cylinder 761, inlet ports 768 and outlet ports 763, similar to that shown in FIG. 27 for the cantilevered embodiment, but that instead shows a free double reed embodiment in which both upper reeds 704 and lower reeds 710 are comprised of thin rectangular strips of flexible material. Two sectional views (in FIGS. 39-42), respectively along sight line 39-39 and along sight line 41-41 in FIG. 38, show cross sections, respectively through the center of a typical outlet port 763 and to one side of a typical outlet port, and show expansion chamber 762 partially hounded by piston 760, cylinder 761 and lower valve plate 771. Both FIG. 39, showing a section through the middle of a representative outlet port, and FIG. 41, a section to one side of a representative outlet port, show upper reed 704 and lower reed 710 in their neutral, relaxed positions. The same two sections along the same two lines of sight are shown in FIGS. 40 and 42, but with upper reed 704 in its closed position supported by curved valve seat 772.

However, in contrast to the previously described embodiment, for which both reeds 504 and 510 were attached at one end with fastener 508, in this embodiment, both reeds 704 and 710 lie constrained between upper valve plate 770 (shown in perspective view in FIG. 44) and lower valve plate 771 (shown in perspective view in FIG. 45) but are otherwise free and not attached or fastened. Rather, they are constrained to remain captured in the pocket formed between the upper and lower valve plates.

Figure 43:
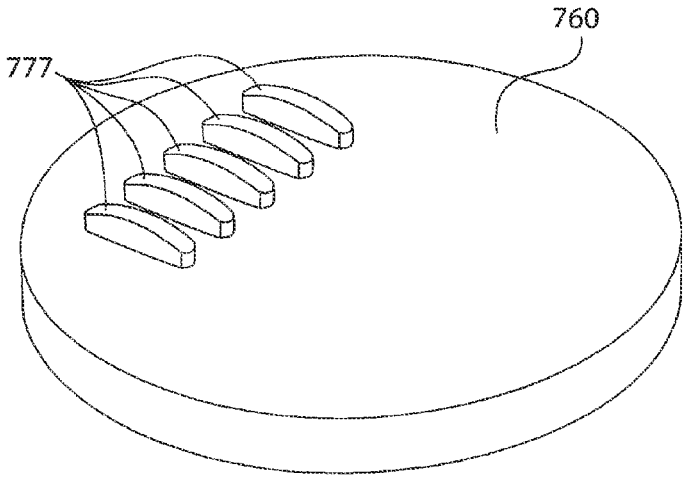
FIG. 43 is a perspective view of the piston with protrusions for use with the free double reed embodiment.
Figure 44:
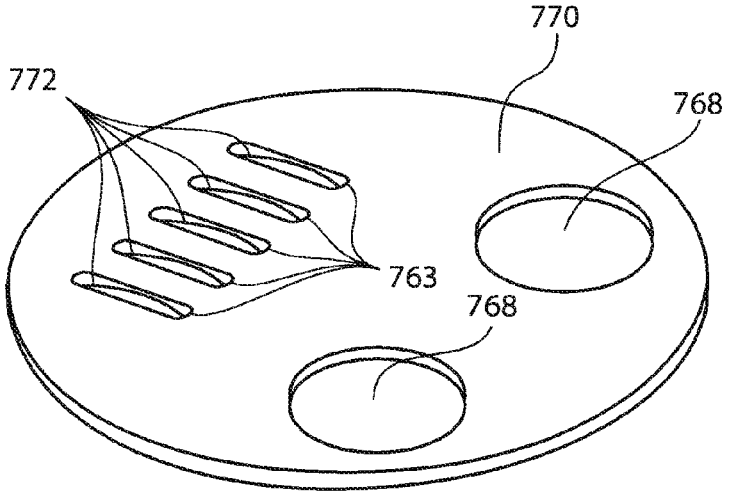
FIG. 44 is a perspective view of the upper valve plate for use with the free double reed embodiment.
Figure 45:
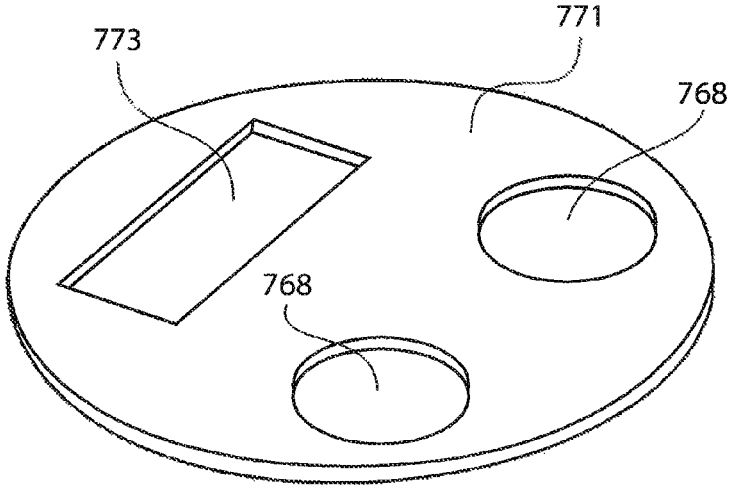
FIG. 45 is a perspective view of the lower valve plate for use with the free double reed embodiment.

In the operation of this embodiment, an optional set of protrusions 777 on piston 760, as best seen in FIG. 43, serve, under low speed operating conditions, to pass through opening 773 in lower valve plate 771 to press both the upper reeds 704 and the lower reeds 710 against the curved seats 772 in upper valve plate 770 as the piston reaches its TDC position. Then, under low speed operating conditions, the opening of the inlet, valve provides a sufficient pressure differential to keep upper reeds 704 closed, while, with the descent of piston 760, lower reeds 710 return to their relaxed, neutral positions. Again, as in earlier embodiments, under high speed operating conditions, the rapid collision of protrusions 777 with the pair of reeds 704 and 710 causes reeds 704 to reach their closed positions ahead of piston 760 reaching its TDC position, and thus a certain degree of compression of the working fluid within expansion chamber 762 occurs before TDC, and upper reeds 704 are held closed as the inlet valve opens and as the piston passes TDC and then descends from TDC.

Each of the variations described in detail above for the cantilevered reed embodiment, including the placing of vent ports near BDC, the use of a reed inlet valve, and the use of a wobble piston mechanism, are also feasible with the free reed embodiment. Furthermore, although protrusions 777 shown on piston 760 help with the closure of the free double reed exhaust valve at low operating speed, they are not necessary for the functioning of the engine. In the absence of protrusions 777 on piston 760, this embodiment would function as described above with a direct transition from "slow aerodynamic closure" to "rapid aerodynamic closure" of the exhaust reeds, without and intermediate "collisional closure" phase. Although this approach to the closure of the exhaust valve could be somewhat less efficient for intermediate operational speeds, it enables the use of a simpler piston, and thus less costly overall engine design.

While particular operational sequences, materials, temperatures, parameters, and particular embodiments have been described and or illustrated, such are not intended to be limiting. Modifications and changes may become apparent to those skilled in the art, and it is intended that the invention be limited only by the scope of the claims.

I claim:

1. An engine comprising:

a cylinder having an inlet and an outlet positioned at a first end of the cylinder;

a piston slidably arranged in the cylinder to together enclose an expansion chamber accessible by the inlet and the outlet, and to move away from the first end of the cylinder during a power stroke and toward the first end of the cylinder during an exhaust stroke;

an inlet valve for controlling the flow of working fluid from a pressurized fluid source through the inlet into the expansion chamber to effect the power stroke;

an exhaust valve for controlling the flow of working fluid exhausted out through the outlet from the expansion chamber during at least a portion of the exhaust stroke, the exhaust valve comprising first and second resiliently-biasing members positioned between the piston and the outlet and co-extending substantially adjacent each other, the first member positioned between the second member and the outlet to occlude the outlet when resiliently biased to a closed position, and the second member positioned between the piston and the first member to resiliently bias the first member to the closed position when the second member is itself resiliently biased by movement of the piston during at least a portion of the exhaust stroke; and periodic return means operably connected to the piston for effecting the exhaust stroke after each power stroke.

2. The engine of claim 1, wherein each of the first and second members has a connector end connected at the first end of the cylinder and an opposite free end extending into the expansion chamber so that the free end of the first member occludes the outlet when the first member is resiliently biased to the closed position.

3. The engine of claim 2, wherein the connector ends of the first and second members are fixedly secured so that the first and second members are cantilevered from the first end of the cylinder.

4. The engine of claim 1, wherein each of the first and second members has two opposing ends constrained at the first end of the cylinder so that the first member occludes the outlet when a center portion thereof is resiliently bowed to the closed position, and the second member resiliently bows the first member when a center portion of the second member is itself resiliently bowed by movement of the piston during at least a portion of the exhaust stroke.

5. The engine of claim 4, wherein the piston has a protrusion positioned to resiliently bow the center portions of the first and second members and second members during at least a portion of the exhaust stroke.

6. The engine of claim 1, wherein the second member is adapted to dampen harmonic oscillation of the first member when the first member is released from the closed position.

7. The engine of claim 1, wherein the cylinder has at least one vent port spaced from the first end of the cylinder to partially exhaust working fluid from the expansion chamber when the piston passes the vent port during the power stroke so as to sufficiently reduce a pressure differential across the first member in the closed position to release the first member from occluding the outlet in advance of the exhaust stroke.

8. The engine of claim 1, wherein the inlet valve comprises an inlet valve head and a resiliently biasing member arranged together as a harmonic oscillator so that the inlet valve head is moveable against an equilibrium restoring force of the resiliently biasing member from an unbiased equilibrium position located outside the expansion chamber to a biased closed position occluding the inlet, and so that upon releasing from the closed position the inlet valve head undergoes at least one oscillation past the equilibrium position to an oppositely biased maximum open position and returns to a biased return position between the closed and equilibrium positions to choke the flow of working fluid and produce a pressure drop across the inlet valve causing the inlet valve to close.

9. The engine of claim 8, wherein the inlet valve head has a lower portion protruding into the expansion chamber when in the closed position so as to enable the piston to bump open the inlet valve from the closed position and initiate at least one oscillation of the inlet valve head.

10. The engine of claim 8, wherein the piston has a protrusion extending towards the inlet valve head so as to enable the piston to bump open the inlet valve from the closed position and initiate at least one oscillation of the inlet valve head.

11. The engine of claim 8, wherein the cylinder has at least one vent port spaced from the first end of the cylinder to partially exhaust working fluid from the expansion chamber when the piston passes the vent port during the power stroke so as to sufficiently reduce a pressure differential across the first member in the closed position to release the first member from occluding the outlet in advance of the exhaust stroke.

12. The engine of claim 1, wherein the periodic return means for effecting the exhaust stroke of the engine after each power stroke is a crank assembly having a flywheel operably connected to the piston to couple rotational motion of the flywheel to reciprocating motion of the piston.

13. The engine of claim 12, wherein the crank assembly includes a piston rod having one end rotatably connected to the flywheel and an opposite end fixedly connected to the piston so as to induce a wobble motion of the piston as it reciprocates in the cylinder, the piston having a flexible flange positioned between the piston and the walls of the cylinder so as to seal the expansion chamber as the piston undergoes the wobble motion.

14. The engine of claim 13, wherein the crank assembly is arranged to tilt the piston towards the outlet on the exhaust stroke and to tilt the piston towards the inlet on the power stroke, so that the second member is bumped by the piston during the exhaust stroke to further bump the first member towards the closed position.

15. The engine of claim 14, wherein the cylinder has at least one vent port located adjacent a second end of the cylinder opposed to the first end of the cylinder that is uncovered by the piston during at least a portion of the exhaust stroke.

16. The engine of claim 14, wherein the inlet valve comprises an inlet valve head and a resiliently biasing member arranged together as a harmonic oscillator so that the inlet valve head is moveable against an equilibrium restoring force of the resiliently biasing member from an unbiased equilibrium position located outside the expansion chamber to a biased closed position occluding the inlet, and so that upon releasing from the closed position the inlet valve head undergoes at least one oscillation past the equilibrium position to an oppositely biased maximum open position and returns to a biased return position between the closed and equilibrium positions to choke the flow of working fluid and produce a pressure drop across the inlet valve causing the inlet valve to close.

17. The engine of claim 16, wherein the inlet valve head has a lower portion protruding into the expansion chamber when in the closed position so as to enable the piston to bump open the inlet valve from the closed position and initiate at least one oscillation of the inlet valve head.

18. The engine of claim 16, wherein the piston has a protrusion extending towards the inlet valve head so as to enable the piston to bump open the inlet valve from the closed position and initiate at least one oscillation of the inlet valve head.

19. A harmonic engine comprising:

a cylinder having an inlet and an outlet positioned at a first end of the cylinder;

a piston slidably arranged in the cylinder to together enclose an expansion chamber accessible by the inlet and the outlet, and to move away from the first end of the cylinder during a power stroke and toward the first end of the cylinder during an exhaust stroke;

an inlet valve for controlling the flow of working fluid from a pressurized fluid source through the inlet into the expansion chamber to effect the power stroke, the inlet valve comprising an inlet valve head and a resiliently biasing member arranged together as a harmonic oscillator so that the inlet valve head is moveable against an equilibrium restoring force of the resiliently biasing member from an unbiased equilibrium position located outside the expansion chamber to a biased closed position occluding the inlet, and so that upon releasing from the closed position the inlet valve head undergoes at least one oscillation past the equilibrium position to an oppositely biased maximum open position and returns to a biased return position between the closed and equilibrium positions to choke the flow of working fluid and produce a pressure drop across the inlet valve causing the inlet valve to close;

an exhaust valve for controlling the flow of working fluid exhausted out through the outlet from the expansion chamber during at least a portion of the exhaust stroke, the exhaust valve comprising first and second resiliently-biasing members positioned between the piston and the outlet and co-extending substantially adjacent each other, the first member positioned between the second member and the outlet to occlude the outlet when resiliently biased to a closed position, and the second member positioned between the piston and the first member to resiliently bias the first member to the closed position when the second member is itself resiliently biased by movement of the piston during at least a portion of the exhaust stroke, wherein the second member is adapted to dampen harmonic oscillation of the first member when the first member is released from the closed position; and periodic return means operably connected to the piston for effecting the exhaust stroke after each power stroke.

20. A harmonic engine comprising:

a cylinder having an inlet and an outlet positioned at a first end of the cylinder;

a piston slidably arranged in the cylinder to together enclose an expansion chamber accessible by the inlet and the outlet, and to move away from the first end of the cylinder during a power stroke and toward the first end of the cylinder during an exhaust stroke;

an inlet valve for controlling the flow of working fluid from a pressurized fluid source through the inlet into the expansion chamber to effect the power stroke, wherein the inlet valve comprises an inlet valve head and a resiliently biasing member arranged together as a harmonic oscillator so that the inlet valve head is moveable against an equilibrium restoring force of the resiliently biasing member from an unbiased equilibrium position located outside the expansion chamber to a biased closed position occluding the inlet, and so that upon releasing from the closed position the inlet valve head undergoes at least one oscillation past the equilibrium position to an oppositely biased maximum open position and returns to a biased return position between the closed and equilibrium positions to choke the flow of working fluid and produce a pressure drop across the inlet valve causing the inlet valve to close;

an exhaust valve for controlling the flow of working fluid exhausted out through the outlet from the expansion chamber during at least a portion of the exhaust stroke, the exhaust valve comprising first and second resiliently-biasing members positioned between the piston and the outlet and co-extending substantially adjacent each other, the first member positioned between the second member and the outlet to occlude the outlet when resiliently biased to a closed position, and the second member positioned between the piston and the first member to resiliently bias the first member to the closed position when the second member is itself resiliently biased by movement of the piston during at least a portion of the exhaust stroke; and a crank assembly for effecting the exhaust stroke of the engine after each power stroke, the crank assembly having a flywheel and a piston rod having one end rotatably connected to the flywheel and an opposite end fixedly connected to the piston to couple rotational motion of the flywheel to wobble motion of the piston as it reciprocates in the cylinder, wherein the piston has a flexible flange positioned between the piston and the walls of the cylinder so as to seal the expansion chamber as the piston undergoes the wobble motion, and the crank assembly is arranged to tilt the piston towards the outlet on the exhaust stroke and to tilt the piston towards the inlet on the power stroke, so that the second member is bumped by the piston during the exhaust stroke to further bump the first member towards the closed position, and wherein the cylinder has at least one vent port spaced from the first end of the cylinder to partially exhaust working fluid from the expansion chamber when the piston passes the vent port during the power stroke so as to sufficiently reduce a pressure differential across the first member in the closed position to release the first member from occluding the outlet in advance of the exhaust stroke.

* * * * *